US009611021B2

(12) United States Patent
Gallato et al.

(10) Patent No.: US 9,611,021 B2
(45) Date of Patent: Apr. 4, 2017

(54) BOAT DRIVE

(71) Applicant: ZF Friedrichshafen AG, Friedrichshafen (DE)

(72) Inventors: Fernando Gallato, Padova (IT); Andrea Tognon, Padova (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 14/909,763

(22) PCT Filed: Aug. 4, 2014

(86) PCT No.: PCT/EP2014/066682
§ 371 (c)(1),
(2) Date: Feb. 3, 2016

(87) PCT Pub. No.: WO2015/036170
PCT Pub. Date: Mar. 19, 2015

(65) Prior Publication Data

US 2016/0176488 A1 Jun. 23, 2016

(30) Foreign Application Priority Data

Sep. 11, 2013 (DE) ..... 10 2013 218 141

(51) Int. Cl.
*B63H 20/08* (2006.01)
*B63H 20/12* (2006.01)
(Continued)

(52) U.S. Cl.
CPC ..... *B63H 5/125* (2013.01); *B63H 25/42* (2013.01); *B63H 2005/1254* (2013.01)

(58) Field of Classification Search
CPC . B63H 5/125; B63H 2005/1254; B63H 25/42
See application file for complete search history.

(56) References Cited

U.S. PATENT DOCUMENTS 2,372,247 A 3/1945 Billing
4,746,311 A 5/1988 Kraus
(Continued)

FOREIGN PATENT DOCUMENTS

JP 2007-8189 A 1/2007
WO 02/24522 A1 3/2002
(Continued)

OTHER PUBLICATIONS

International Search Report Corresponding to PCT/EP2014/066682 mailed Nov. 21, 2014.
(Continued)

*Primary Examiner* — Anthony Wiest
(74) *Attorney, Agent, or Firm* — Davis & Blujold, PLLC; Michael J. Bujold

(57) ABSTRACT

A boat drive has an underwater housing (10) which is arranged outside of a boat hull (7) and can swivel relative to the boat hull (7) about a vertical swivel axis (11). In the housing at least one propeller shaft (13) is mounted and can be driven. A swivel drive mechanism is arranged in the inside space (6) of the boat hull (7) for swiveling the underwater housing (10) in order to control the driving direction of the boat. A zero-position mark (25) is provided on an element of the swivel drive mechanism, which facilitates easy determination of a zero position of the underwater housing (10).

9 Claims, 2 Drawing Sheets

(51) Int. Cl.

| | |
|---|---|
| ***B63H 25/42*** | (2006.01) |
| ***B63H 5/125*** | (2006.01) |
| ***B63H 25/36*** | (2006.01) |

(56) References Cited

U.S. PATENT DOCUMENTS

| | | | | |
|---|---|---|---|---|
| 7,131,385 | B1 * | 11/2006 | Ehlers | B63H 25/42<br>114/145 R |
| 8,506,337 | B2 | 8/2013 | Gallato et al. | |
| 8,651,905 | B2 | 2/2014 | Zottele et al. | |
| 2001/0029133 | A1 | 10/2001 | Breems | |
| 2008/0190227 | A1 * | 8/2008 | Myers | B63H 20/08<br>74/22 R |
| 2011/0318978 | A1 * | 12/2011 | Krackhardt | B63H 5/125<br>440/6 |

FOREIGN PATENT DOCUMENTS

| | | | |
|---|---|---|---|
| WO | 2005/005249 | A1 | 1/2005 |
| WO | 2010/037744 | A2 | 4/2010 |
| WO | 2010/094612 | A1 | 8/2010 |

OTHER PUBLICATIONS

Written Opinion Corresponding to PCT/EP2014/066682 mailed Nov. 21, 2014.
International Preliminary Report on Patentability Corresponding to PCT/EP2014/066682 mailed Sep. 2, 2015.

* cited by examiner

BOAT DRIVE

This application is a National Stage completion of PCT/EP2014/066682 filed Aug. 4, 2014. which claims priority from German patent application serial no. 10 2013 218 141.8 filed Sep. 11, 2013.

FIELD OF THE INVENTION

The invention concerns a boat drive with an underwater housing arranged outside of and able to swivel relative to the boat hull, in which housing at least one propeller shaft that can be driven in rotation is arranged, and with a swivel drive mechanism to swivel the underwater housing about a vertical swivel axis in order to control the direction of the boat. Such boat drives are also known as POD drives.

BACKGROUND OF THE INVENTION

In such boat drives a propeller is fixed to the drive output end of the propeller shaft, which during operation provides the propulsion of the boat when the propeller shaft is rotating. With the help of the swiveling underwater housing the travel direction of the boat can be changed, since when the underwater housing is swiveled the propulsion vector produced by the rotating propeller also changes its direction.

WO 02/24522 A1 describes such a boat drive with an underwater housing arranged outside of and able to swivel relative to the boat hull. In this boat drive, a propeller shaft that can be driven in rotation is arranged in the underwater housing. The swiveling movement of the underwater housing is brought about by a swivel drive mechanism with a swivel drive motor arranged on the inside of the boat hull.

A further boat drive with an underwater housing arranged and able to swivel underneath the boat hull is known from WO 2005/005249 A1. in this case the propeller shaft mounted in the underwater housing and its associated propeller are driven by a drive motor arranged inside the boat hull by way of two bevel gear transmissions and the corresponding driveshafts. Here too, the swiveling movement of the underwater housing is brought about by a swivel drive mechanism with a swivel drive motor arranged on the inside of the boat hull.

In WO 2010/094612 A1 as well, a boat drive of similar type with a swivel drive mechanism in the form of a control device is described, In that case a boat drive with a swivel drive mechanism is described, in which to control the travel direction an underwater housing with a propeller can be swiveled with the help of two electric servomotors as swivel drive motors.

Furthermore WO 10037744 A2 describes a device for detecting an angular position of a swivel control shaft in connection with a boat drive of the type described at the start, such that with the device the current swivel position of the swiveling underwater housing is detected and used for controlling a motorized swivel drive mechanism.

All the documents mentioned lack any indication about whether or how the boat drives described can be controlled in the event that the swivel drive motors or their controls should fail. Methods are known, in which after a failure of the swivel drive motor the swivel drive mechanism of such a boat drive can be actuated manually from inside the boat hull. In this, however, it is disadvantageous that the current swivel position of the underwater housing cannot be recognizer from inside the boat.

SUMMARY OF THE INVENTION

The purpose of the present invention, therefore, is to provide a boat drive with an underwater housing arranged outside of and able to swivel relative to the boat hull, which can be operated as simply as possible even when a motorized swivel drive mechanism or its controls have failed.

This objective is achieved by a boat drive as discussed below.

Accordingly, the invention concerns a boat drive with an underwater housing arranged outside of a boat hull relative to which it can swivel about a vertical swivel axis, in the housing at least one propeller shaft is mounted and can be driven, and with a swivel drive mechanism arranged on the inside of the boat hull for swivelling the underwater housing in order to control the direction of the boat. On an element of the swivel drive mechanism a zero-position mark is provided, which enables the simple determination of a zero position of the underwater housing.

With the help of the zero-position mark, in the event of failure of the motorized swivel drive mechanism the zero position of the underwater housing can be rapidly and simply set manually. From the prior art, methods are known for swivelling an underwater housing manually if a motorized swivel drive mechanism has failed. To do this, for example covers on the swivel drive mechanism motor or motors is/are first removed, so that if necessary motor brakes or other blocking elements of the swivel drive mechanism can be opened or removed, Thereafter the swivel drive mechanism can be actuated manually, for example with a tool, the tool being applied to some appropriate point of the swivel drive mechanism. However the position of the underwater housing cannot be recognized from inside the boat, so that with conventional boat drives it is problematic to set the desired zero position of the underwater housing by manual means. The zero-position mark according to the invention solves that problem, since it indicates to the operator inside the boat hull when the zero position of the underwater housing has been set.

The zero position of the underwater housing corresponds to when the boat is travelling straight ahead, i.e. in the zero position a longitudinal axis of the underwater housing is parallel to a longitudinal axis of the boat. In relation to a full swivelling range between two end positions, the zero position is not necessarily at the geometrical central point between the two end positions, because starting from the zero position the underwater housing of a POD drive can swivel farther in a first swivel direction than it can in the opposite, second swivel direction. This makes it even more difficult to find the zero position when manually operating a conventional swivel drive mechanism.

In the zero position the flow resistance through the water is lowest, particularly when the boat is traveling straight ahead. Consequently it is advantageous, in the event that the entire boat drive or the swivel drive mechanism should fail, to be able to set the zero position manually from inside the boat as simply as possible. Another reason for wanting to be able to set the zero position manually as simply as possible is, for example, that many maintenance jobs such as changing the oil in a transmission housing of the boat drive can only be carried out in the zero position, whereas the swivel drive mechanism during maintenance work is not available or should only be actuated manually for safety reasons.

A preferred design provides that the swivel drive mechanism comprises a swivel-restricting element and a swivel control shaft, which are in drivable connection with a swivel drive motor and are connected fixed to the underwater housing. The swivel-restricting element and the swivel control shaft can even be made integrally as one piece. The drive power and swivel movement from the swivel drive motor can be transmitted to the underwater housing during swiveling operation by way of the swivel-restricting element and the swivel control shaft The fixed connection between the swivel-restricting element, the swivel control shaft and the underwater housing has the result that every position of the swiveling underwater housing corresponds to a definite and determined position of the swivel-restricting element. In other words, from the position of the swivel-restricting element on the inside of the boat hull, the position of the underwater housing can be recognized clearly.

Preferably therefore, the zero-position mark is arranged on the swivel-restricting element or on the swivel control shaft. Particularly preferably, the zero-position mark is arranged on the swivel-restricting element because as a rule the swivel-restricting element is arranged on a part of the swivel control shaft that faces toward the inside of the boat, which can be seen most easily from inside the boat hull.

According to a further preferred design of the invention the swivel drive mechanism is arranged in a transmission housing of the boat drive. The transmission housing then has a viewing port through which the zero-position mark can be seen, at least in the zero position. From this it is obvious that the viewing port should advantageously be arranged in the transmission housing in a position such that the zero-position mark can be recognized as easily as possible by a person inside the boat hull, i.e. in an easily accessible and visible position on the transmission housing.

Furthermore, the viewing port is preferably positioned in such manner on the transmission housing and is of a size such that the zero-position mark can only be recognized in the zero position, In other words the viewing port is small enough for the zero-position mark to be visible through it only in the zero position, i.e. when the underwater housing is at least nearly in its zero position. This gives the operator the confidence that he has set the desired zero position as soon as he recognizes the zero-position mark through the viewing port.

Another preferred design provides that the transmission housing or the viewing port has a reference mark which corresponds with the zero-position mark in the zero position. The reference mark facilitates the exact positioning of the swivel drive mechanism during manual actuation, particularly if the zero-position mark is visible through the viewing port in a wider range around the zero position, for example because the viewing port is larger than in the version previously described. A design with a larger viewing port has the advantage that a manual operator can recognize the current position of the swivel drive mechanism and hence that of the underwater housing even when the exact zero position has not yet been reached. This makes it easier for him to turn the swivel drive mechanism in the correct direction during manual setting, for finding the zero position. For setting the exact zero position, the reference mark is then helpful since in the zero position it is exactly over or opposite the zero-position mark.

Preferably the zero-position mark is a recess such as a notch, a hole or a groove. Such a mark is easy to make and is also stable under the conditions prevailing in a transmission housing, so that the mark cannot be effaced over the lifetime of the boat drive.

According to a further preferred design, it is provided that the swivel drive mechanism has two end positions determined by at least one end-stop element fixed on the transmission housing, this end-stop element co-operating with at least one stop surface on the swivel-restricting element. For example, the end-stop element is in the form of a bolt fixed on the housing, which projects into an opening of the swivel-restricting element. Thus, when the swivel-restricting element moves, the opening travels with it along a circular path during swiveling. Accordingly, for example, the opening has the shape of a circular arc such that the two ends of the circular-arc opening correspond to the end positions of the swivel range and each of them has a stop surface. When each end position is reached the bolt fixed to the housing comes up against a stop surface of the opening.

Preferably, the end-stop element has means for end-position damping as the two end positions are approached. By virtue of the opening in combination with the end-stop element and the end-position damping, the swivel-restricting element fulfills several functions. It is used for transmitting the swiveling torque and the swiveling movement, for restricting the swivel range, and for indicating the zero-position. This multi-functionality enables a swivel drive mechanism to be produced with a small number of components, and one which occupies little structural space.

The swivel control shaft can perform a further function if it co-operates with a device for determining an angular position of the swivel control shaft, such as that described in WO 10037744 A2. For this, the swivel control shaft can have further teeth at a point where they engage with the teeth of the device for detecting the angular position, thus making it possible to detect the current swivel position. However, since with such devices the information about the current swivel position is only available for the motorized swivel drive mechanism, this aspect will not be discussed in any further depth in connection with the present invention.

Still another function can be performed by the swivel control shaft if, in accordance with a further preferred design, it has at least one oil duct which, at least in the zero position, enables oil to be changed in the underwater housing from the inside of the boat hull. Since transmission elements and bearings for the propeller shaft are arranged in the underwater housing, as a rule the underwater housing also comprises an oil lubrication system. For maintenance purposes it is advantageous to be able to change the oil of this oil lubrication system from inside the boat hull as well, This makes it unnecessary to dry-dock the boat for such maintenance work. The oil can be changed, in that it is drawn out of the underwater housing by way of an oil duct in the swivel control shaft and can be replaced again with fresh oil through the same duct. Since the motorized swivel drive mechanism is turned off during maintenance work, for example for safety reasons, in this case too the zero-position mark serves to determine and manually set the zero position.

BRIEF DESCRIPTION OF THE DRAWINGS

Below, the invention and further advantages thereof are explained in greater detail with reference to the associated figures, which show.

DETAILED DESCRIPTION OF THE PREFERRED EMBODIMENTS

Figure 1:
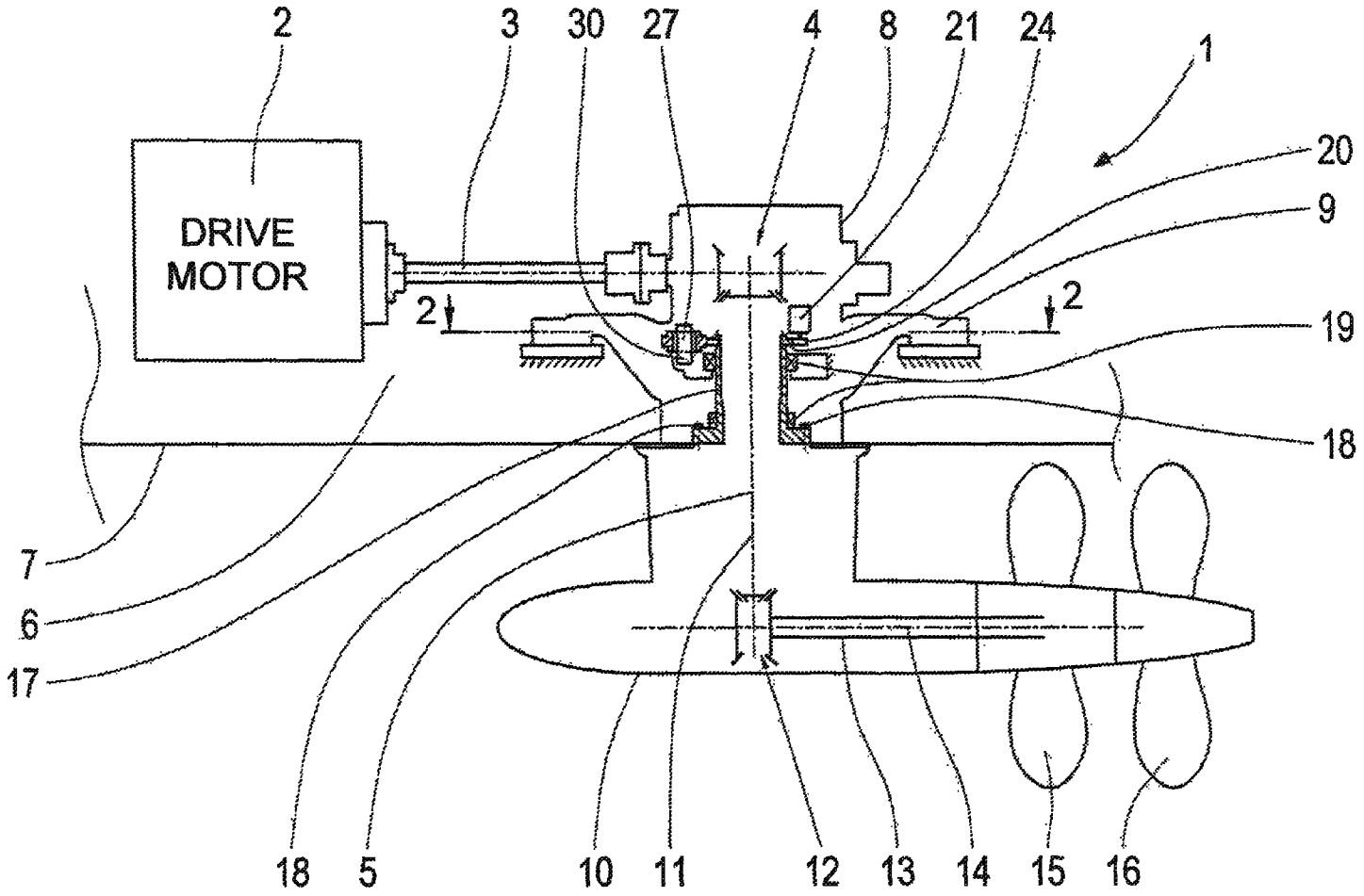
FIG. 1: A schematic sectioned representation of a boat drive according to the invention, viewed from the side.

The boat drive 1 shown in FIG. 1 comprises a drive motor 2, a motor drive output shaft 3 and a first transmission 4 which is designed as an angled, bevel gear transmission and transmits the drive power from the at least almost horizontally arranged motor drive output shaft 3 to an at least almost vertically arranged driveshaft 5. The drive motor 2, the motor drive output shaft 3 and the first transmission 4 are arranged in the inside space 6 of a boat hull 7. The drive motor 2 and the first transmission 4 are fixed inside the boat hull 7. To fix the transmission housing 8 of the first transmission 4 in the boat hull 7, the transmission housing 8 has fixing arms 9.

Outside the boat hull 7 is arranged the underwater housing 10. It can be swiveled relative to the boat hull 7 about an at least approximately vertically arranged swivel axis 11. In FIG. 1 the swivel axis 11 together with the vertically extending driveshaft 5 are represented as a line. The driveshaft 5 connects the first transmission 4 inside the boat hull 7 to a second transmission 12, which is arranged outside the boat hull 7 and inside the underwater housing 10, and which is also in the form of an angled, bevel gear transmission. The second transmission 12 transmits the drive power of the boat drive 1 from the driveshaft 5 to the at least approximately horizontally arranged propeller shafts 13 and 14. At the drive output end, a respective propeller 15 or 16 is attached to each propeller shaft 13 and 14. In this case one propeller shaft 13 is in the form of a hollow shaft and is arranged concentrically over the other propeller shaft 14. Independently of the embodiment with two propellers, the present invention also covers embodiments that have only one propeller.

The swivel drive mechanism for swiveling the underwater housing 10 relative to the boat hull 7 comprises a swivel drive motor 21, which by way of a swivel-restricting element 20 and a swivel control shaft 17 can swivel the underwater housing 10 within a certain swivel range. The swivel drive motor 21 is connected fixed to the transmission housing 8, whereas the swivel-restricting element 20 and the swivel control shaft 17 are mounted to rotate within the transmission housing 8 with the help of roller bearings 19, about the swivel axis 11. To power the swivel drive mechanism, the swivel drive motor 21 comprises a drive output pinion 24 with gearteeth 22, the gearteeth 22 being in driving connection with gearteeth 23 of the swivel-restricting element 20. In the drive connection between the swivel drive motor 21 and the swivel-restricting element 20 other transmission elements too may be arranged in order to produce a necessary drive input gear ratio of the swivel drive mechanism. Although the swivel control shaft 17 is part of the swivel drive mechanism arranged within the inside space 6, parts of the swivel control shaft 17 can also project slightly out of the boat hull 7 in the area where the swivel control shaft 17 is connected fixed to the underwater housing 10 arranged outside of the boat hull 7.

The swivel-restricting element 20 is connected fixed to the swivel control shaft 17. The swivel control shaft 17 is in turn connected fixed to the underwater housing 10, so that when the underwater housing 10 swivels, it does so through exactly the same angle as the swivel-restricting element 20. In the example embodiment shown, the swivel control shaft 17 is bolted to the underwater housing 10 by means of fixing screw-bolts 18.

The swivel-restricting element 20 has a circular-arc-shaped opening 27 in which a bolt fixed to the housing is arranged as an end-stop element 30, The bolt 30 is connected fixed to the transmission housing 8 and can even be made integrally with the transmission housing 8. For example, the bolt 30 can be made as part of a cast transmission housing 8.

When the underwater housing 10 swivels, the opening 27 moves about the swivel axis 11 along a curved circular path together with the swivel-restricting element 20. When the respective end positions are reached, the stop surfaces 28 and 29 at the two ends of the arc-shaped opening 27 come up against the bolt 30 fixed to the housing, which bolt serves as an end-stop element. Thereby, the swivel range is restricted in both directions.

Figure 2:
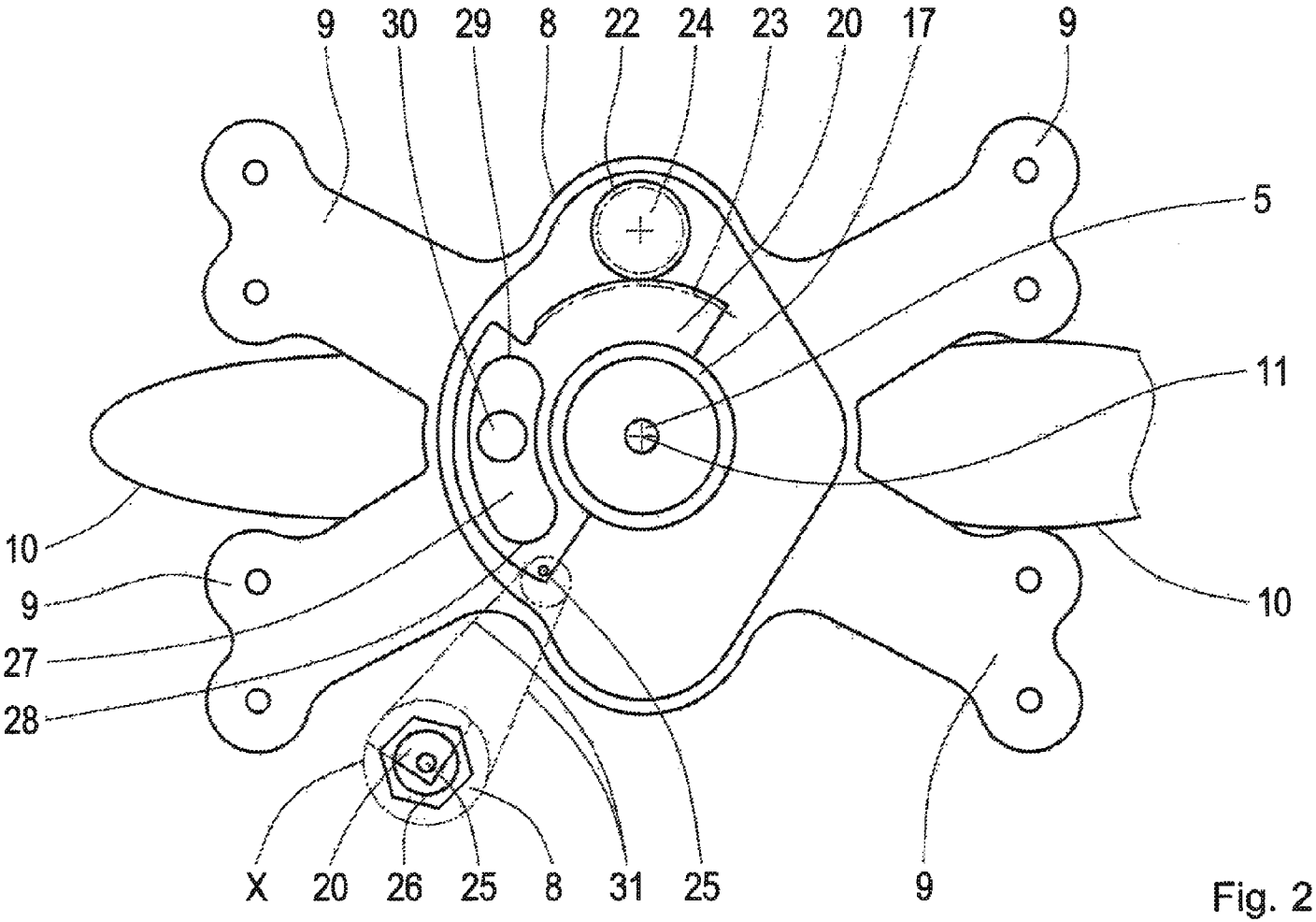
FIG. 2: A schematic representation, sectioned along the section plane 2-2 shown in FIG. 1, of the boat drive according to the invention as viewed from above.

FIG. 2 shows the swivel drive mechanism and with it the underwater housing 10 in their zero position. A zero-position mark 25 is made on the swivel-restricting element 20. In this case the zero-position mark 25 is made as a recess in the form of a blind hole in the swivel-restricting element 20.

In the viewing port area X in FIG. 2, a view from outside the transmission housing 8 onto a viewing port 26 is shown. The viewing port 26 is arranged on the transmission housing in such manner that the zero-position mark 25 can be seen through the viewing port 26. This is made clear by the projection lines 31 in FIG. 2. The viewing port 26 is at least large enough for the zero-position mark 25 to be visible through the viewing port 26 when in the zero position.

If the distance between the viewing port 26 in the transmission housing 8 and the zero-position mark 25 inside the transmission housing 8 is large, then at various viewing angles through the viewing port 26 undesired inaccuracies may occur when determining the zero position. This can be remedied by a reference mark (not shown here), which is made inside the transmission housing 8 close to the zero-position mark 25 on the transmission housing 8 or fixed to the housing on some other component. The correct zero position has then been set when the reference mark is opposite the zero-position mark 25, i.e. when the fixed reference mark on the housing is the shortest distance away from the zero-position mark 25 on the swivel-restricting element 20.

INDEXES

1 Boat drive
2 Drive motor
3 Motor drive output shaft
4 First transmission
5 Driveshaft
6 Inside space
7 Boat hull
8 Transmission housing
9 Fixing arm
10 Underwater housing
11 Swivel axis
12 Second transmission
13 Propeller shaft
14 Propeller shaft
15 Propeller
16 Propeller
17 Swivel control shaft
18 Fixing screw-bolt
19 Roller bearing
20 Swivel-restricting element
21 Swivel drive motor
22 Gearteeth
23 Gearteeth
24 Drive pinion
25 Zero-position mark
26 Viewing port
27 Opening
28 Stop surface
29 Stop surface
30 End-stop element
31 Projection lines
X Viewing port area

The invention claimed is:

1. A boat drive with an underwater housing (10) being arranged outside a boat hull (7) and swivelable relative to the boat hull (7) about a vertical swivel axis (11), at least one propeller shaft (13) being mounted to the underwater housing and being drivable, a swivel drive mechanism being arranged in an inside space (6) of the boat hull (7) for swiveling the underwater housing (10) in order to control a direction of the boat drive, the swivel drive mechanism comprising a swivel-restricting element (20) and a swivel control shaft (17) which are in drive connection with a swivel drive motor (21) and being fixedly connected to the underwater housing (10), a zero-position mark (25) being located either on the swivel-restricting element (20) or on the swivel control shaft (17), and the zero-position mark enabling easy determination of a zero position of the underwater housing (10), the swivel drive mechanism being arranged in a transmission housing (8) of the boat drive (1), and the transmission housing (8) having a viewing port through which the zero-position mark (25) is viewable, at least in the zero position.

2. The boat drive according to claim 1, wherein the zero-position mark (25) is located on the swivel-restricting element (20).

3. The boat drive according to claim 1, wherein the viewing port is positioned on the transmission housing (8) and is of a size such that the zero-position mark (25) is only recognizable in the zero position.

4. The boat drive according to claim 3, wherein the swivel drive mechanism has two end positions which are determined by at least one end-stop element (30) that is fixed on the transmission housing (8), and the end-stop element (30) co-operates with at least one stop surface (28, 29) on the swivel-restricting element (20).

5. The boat drive according to claim 4, wherein the end-stop element (30) has a damping assembly for damping the end position as the two end positions are approached.

6. The boat drive according to claim 1, wherein either the transmission housing (8) or the viewing port has a reference mark which corresponds with the zero-position mark (25) in the zero position.

7. The boat drive according to claim 1, wherein the zero-position mark (25) is a recess.

8. The boat drive according to claim 1, wherein the swivel control shaft (17) has at least one oil duct which, at least in the zero position, enables an oil change in the underwater housing (10) from the inside space (6) of the boat hull (7).

9. A boat drive for a boat, the boat drive comprising:

an underwater housing being arranged outside a boat hull and being pivotable relative to the boat hull about a vertical swivel axis, and at least one propeller shaft (13) being rotatably supported within the underwater housing such that the underwater housing defines a drive direction of the boat;

a swivel drive mechanism being arranged within an inside space of the boat hull for swiveling the underwater housing in order to control a drive direction of the boat;

the swivel drive mechanism comprising a swivel-restricting element that is fixed to a swivel control shaft which is fixed to the underwater housing, the swivel-restricting element being driven by a swivel drive motor such that actuation of the swivel drive motor swivels the swivel-restricting element, the swivel control shaft and the underwater housing about the vertical swivel axis, and the underwater housing being swivelable about the vertical swivel axis between first and second end positions;

a zero-position mark being located on either the swivel-restricting element or the swivel control shaft, the zero-position mark facilitating identification of a zero position of the underwater housing, the zero position of the underwater housing being defined as a swivel position of the underwater housing in which the drive direction of the boat is parallel to a longitudinal axis of the boat, the swivel drive mechanism being arranged in a transmission housing of a drive transmission and fixed relative to the boat hull, and the transmission housing having a viewing port through which the zero-position mark is viewable, at least when the underwater housing is in the zero position.

* * * * *